United States Patent [19]

Motzer

[11] Patent Number: 4,903,727

[45] Date of Patent: Feb. 27, 1990

[54] SAFETY VALVE

[75] Inventor: Helmut Motzer, Leinfelden-Echterdingen, Fed. Rep. of Germany

[73] Assignee: Herion-Werke KG, Fellbach, Fed. Rep. of Germany

[21] Appl. No.: 344,352

[22] Filed: Apr. 26, 1989

[30] Foreign Application Priority Data

May 19, 1988 [DE] Fed. Rep. of Germany ..... 3817120

[51] Int. Cl.[4] ..... F15B 13/043

[52] U.S. Cl. ..... 137/596.16; 91/424; 137/596.18

[58] Field of Search ..... 91/424; 137/596.16, 137/596.18

[56] References Cited

U.S. PATENT DOCUMENTS 4,473,095 9/1974 Motzer ..... 137/596.16

*Primary Examiner*—Gerald A. Michalsky

*Attorney, Agent, or Firm*—Henry M. Feiereisen

[57] ABSTRACT

A hydraulically actuated safety valve includes two electromagnetically actuable pilot valves and is provided with two coaxial valve bodies movable in opposite direction towards each other. One of both pilot valves is designed as a proportional pressure differential valve and one of both valve bodies is provided with fine control notches. Thus, upon suitable actuation of the proportional pressure differential valve, the fine control notches clear a respective cross-section between the pump port and the working port and between the working port and the tank port to thereby allow a control of the speed and pressure buildup of a consumer such as e.g. a cylinder or a motor which is connected to the working port.

7 Claims, 6 Drawing Sheets

SAFETY VALVE

BACKGROUND OF THE INVENTION

The invention relates to a hydraulically actuatable safety valve and in particular to a safety valve with a valve housing accommodating two valve bodies movable in opposite direction toward each other in a bore of the housing, two e.g. electromagnetically actuatable pilot valves, an inlet port for connection to a pump, a working port and an outlet port for connection to a tank, with each valve body including a working piston acted upon by a pressure fluid via the pilot valves and control channels, and further including at least one control piston connected to the working piston and regulating the passageways between the working port, the pump port and the tank port wherein the working port is connectable to the tank port upon occurrence of a faulty switching.

A safety valve of this kind is known from German patent No. 31 04 957 and is used, for example, for controlling the brake and the clutch of a mechanical press. This known safety valve includes two directional control valves which ensure a braking action upon failure of one valve. The directional control valves are checked automatically without requiring any additional devices such as, for example, electric checking elements.

SUMMARY OF INVENTION

It is an object of the present invention to provide an improved safety valve which allows a control of speed and pressure increase of a consumer connected to the working port.

This object and others which will become apparent hereinafter are attained in accordance with the present invention by providing one of both pilot valves as proportional pressure differential valve, and by providing the control pistons associated to this pilot valve with fine control notches.

Further features of the invention are defined in the subclaims.

BRIEF DESCRIPTION OF THE DRAWING

The above and other objects, features and advantages of the present invention will now be described in more detail with reference to the accompanying drawing in which.

DETAILED DESCRIPTION OF A PREFERRED EMBODIMENT

Figure 1:
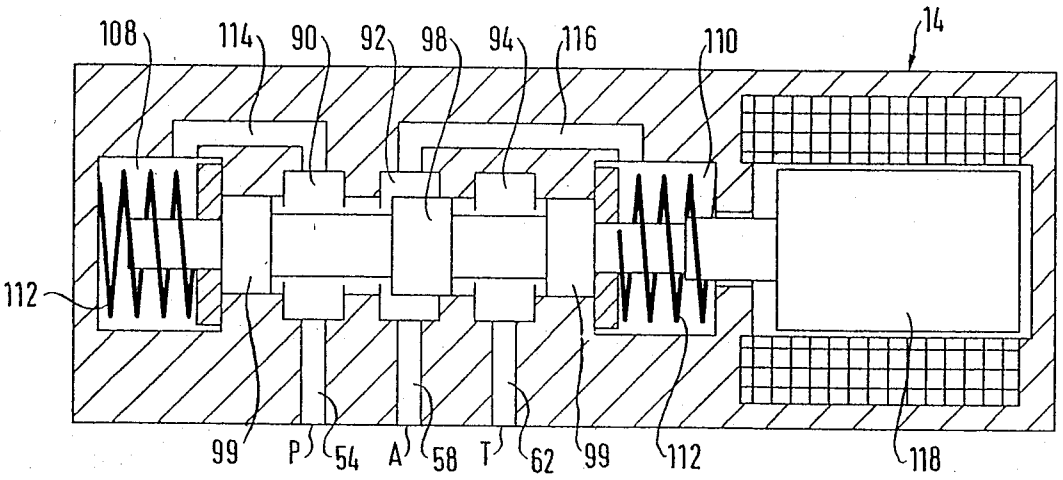
FIG. 1 is a sectional view of a proportional pressure differential valve.

Referring now to the drawing and in particular to FIG. 1, there is shown a proportional pressure differential valve which is generally designated by reference numeral 14 and subsequently referred to in short as proportional valve. The proportional valve 14 has a central bore accommodating a piston 98 reciprocating in axial direction and being connected with a proportional magnet 118 of the valve. The piston 98 is centered within the housing of the proportional valve 14 by compression springs 112, with one compression spring 112 being arranged in a spring chamber 108 and the other pressure spring being arranged in the spring chamber 110. The piston 98 is guided within the housing by means of collars 99 which bear against undesignated disks arranged in the spring chambers and loaded by the compression springs 112.

The housing further includes annular channels 90, 92 and 94, with annular channel 90 communicating with a control channel 54 while annular channel 92 communicates with a control channel 58 and annular channel 94 communicates with a control channel 62. A passageway 114 connects the spring chamber 108 with the annular channel 90 and a passageway 116 connects the spring chamber 110 with the annular chamber 92.

Figure 2:
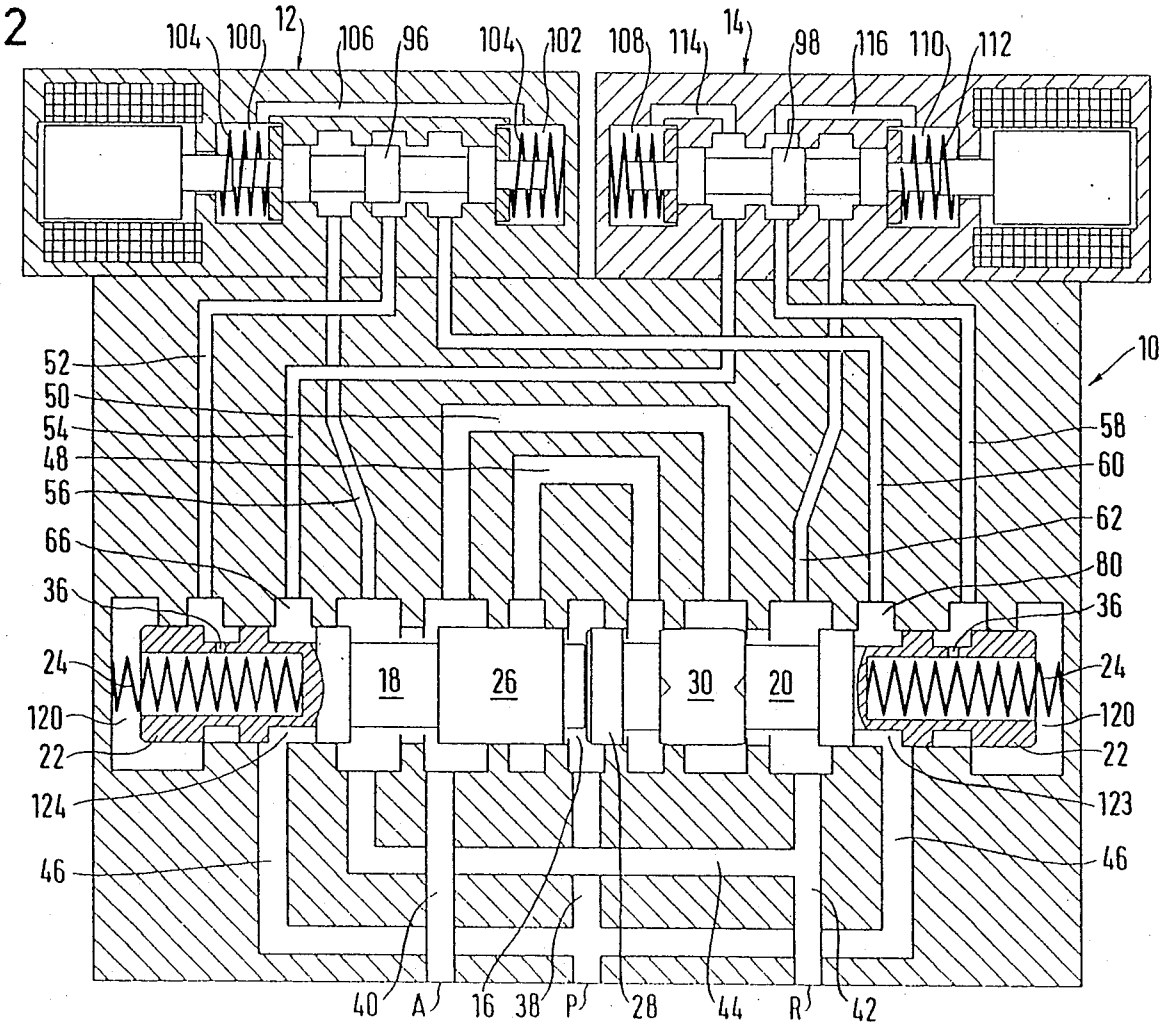
FIG. 2 is a sectional view of one embodiment of a safety valve in accordance with the present invention, with the safety valve occupying the normal position and including pilot valves flanged thereto, with one pilot valve being designed as proportional pressure differential valve.

The proportional valve 14, according to FIG. 1, represents one of the pilot valves of the safety valve 10 which is illustrated in normal position in FIG. 2 and further includes a pilot valve 12 which is flanged thereto.

The pilot valve 12 accommodates a conventional piston 96 which is connected with the electromagnet of the pilot valve 12 and is centered within the housing of the pilot valve 12 by compression springs 104 arranged in the spring chambers 100, 102. Both spring chambers 100, 102 are connected with each other via a passageway 106.

Figure 4:
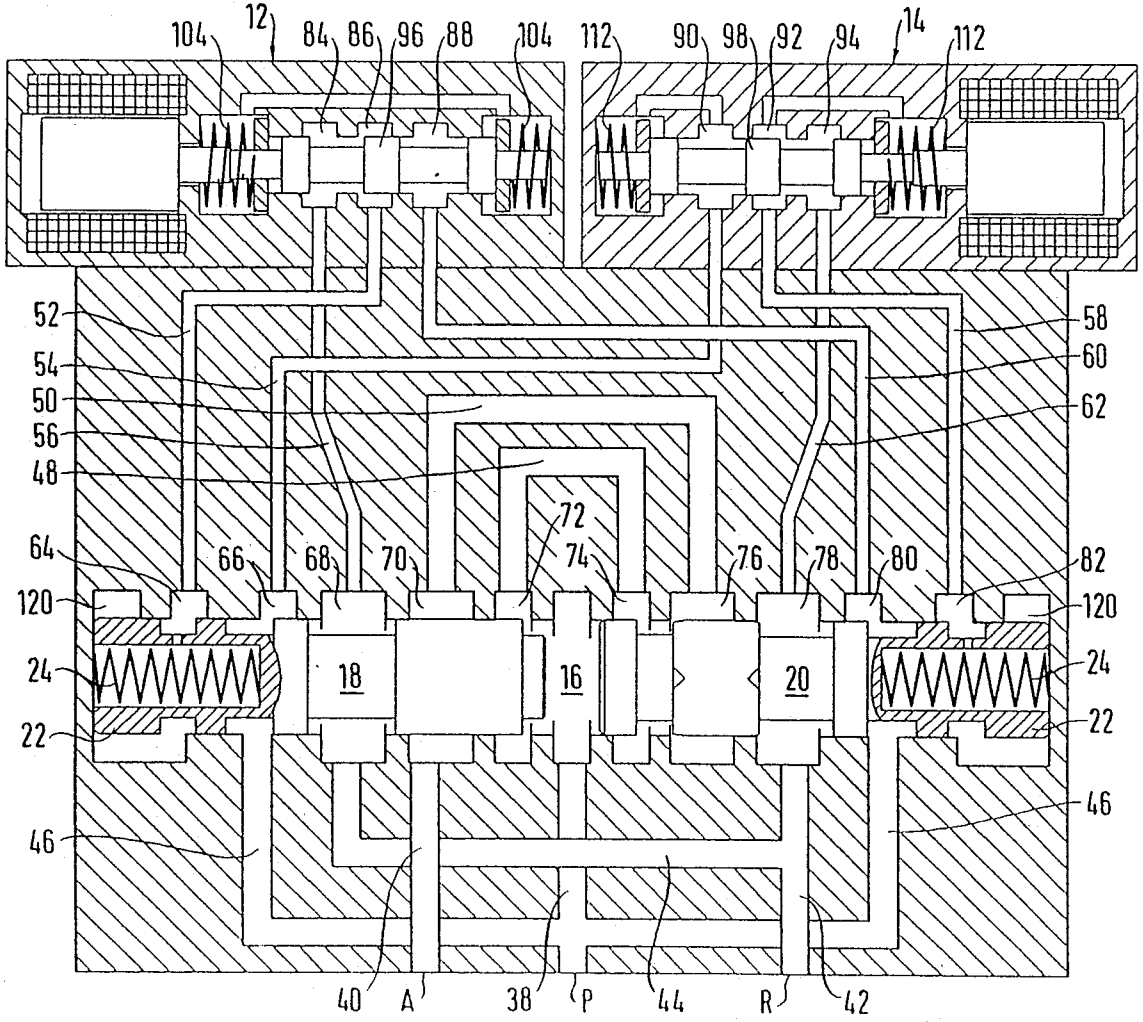
FIG. 4 is a sectional view of the safety valve according to FIG. 2 in switching position.

As can be seen from FIG. 4, the housing of the pilot valve 12 further includes annular channels 84, 86 and 88, with annular channel 84 being connected to a control channel 56, annular channel 86 being connected to a control channel 52, and annular channel 88 communicating with a control channel of the safety valve 10.

The safety valve 10 has a central bore 16 (FIG. 4), with two valve bodies 18, 20 axially movable in opposite direction towards each other. Each of the valve bodies 18, 20 is provided with a working piston 22 which includes a blind-end bore accommodating a compression spring 24, with both compression springs 24 attempting to axially push both valve bodies 18, 20 toward each other. Each working piston 22 is further provided with a transverse bore 36 which connects the blind-end bore with an annular space outside the respective working piston 22.

The valve body 18 is provided with a control piston 26 and the valve body 20 is provided with two control pistons 28, 30 arranged at an axial distance from each other. The control piston 30 is provided at its one end face with fine control notches 32 and at its other end face with fine control notches 34, with the fine control notches 32, 34 slightly extending from the respective end face in axial direction into the outer circumference of the control piston 30. As will be described further below, by means of the fine control notches 32, 34, the connections between pump port P and working port A and working port A and tank port R are controllable.

Arranged within the housing of the safety valve 10 is a passageway 38 which extends from the central bore 16 to the pump port P. The housing is further provided with a passageway 40 extending from the central bore 16 to the working port A, and a passageway 42 extending from the central bore 16 to the tank port R.

Branching off passageway 42 is a branch 44 which also communicates with the central bore 16. Further branches 46 branch off channel 38, with each branch 46 communicating with the central bore 16 in the area of the respective working piston 22.

As shown in particular in FIG. 4, the central bore 16 is provided with annular channels 68, 70, 72, 74, 76, 78. A passageway 48 connects the annular channels 72, 74 while a passageway 50 connects the annular channels 70, 76 with each other. The central bore 16 is further provided with one-sided pockets 64, 66, 80, 82. The passageway 40 connected to the working port A extends into the annular channel 70 while the passageway 38 which is in communication with the pump port P extends into an undesignated annular channel between both valve bodies 18, 20, and the passageway 42 which leads to the tank port R extends into the annular channel 78. Branch 44 communicates with annular channel 68 while both branches 46 directly communicate with the central bore 16.

Extending from the pockets 64, 66, 80, 82 and the annular channels 68, 70, 72, 74, 76, 78 are the control channels 52, 54, 56 as well as the control channels 58, 60 and 62.

The control channel 52 connects the pocket 64 with the annular channel 86 of the pilot valve 12 while the control channel 54 connects the pocket 66 with the annular channel 90 of the proportional valve 14 and the control channel 56 connects the annular channel 68 with the annular channel 84 of the pilot valve 12. The control channel 58 extends between the pocket 82 and the annular channel 92 of the proportional valve 14 while the annular channel 60 connects the pocket 80 with the annular channel 88 of the pilot valve 12 and the control channel 62 connects the annular channel 78 with the annular channel 94 of the proportional valve 14.

After having described the individual elements of the safety valve in accordance with the present invention, its mode of operation will now be set forth in more detail.

In the normal position as shown in FIG. 2, pilot valves 12 and 14 are not excited and their pistons 96, 98 are kept in the normal position by the springs 104, 112.

When the safety valve 10 occupies the normal position, pressure fluid flows from the pump port P via the left branch 46, annular space 124 of piston 22, pocket 66 and the control channel 54 into the pilot valve 14, and then via control channel 58 into the pocket 82 and further via the transverse bore 36 into the blind-end bore of the right working piston 22 and thus into the spring chamber 120 on the right-hand side of the drawing. In addition, pressure fluid flows via the right branch 46, the annular space 123 of piston 22, pocket 80 and the control channel 60 into the pilot valve 12 and further via the control channel 52 into the pocket 64 and then via the transverse bore 36 into the blind-end bore of the left working piston 22 nd thus into the spring chamber 120 on the left-hand side of the drawing. Since pressure fluid flows through passageway 38, the supply pressure prevails in the central bore 16 in the area between both valve bodies 18, 20 so that forces generated by the pressure fluid compensate each other, and both bodies 18, 20 are urged towards each other by the compression springs 24 into the position as shown in FIG. 2.

In this position, the working port A is pressure-relieved as it is connected with the tank port R via the passageway 40, annular chambers 70, 68 and branch 44 as well as via passageway 50, annular channel 76, fine control notch 34, annular channel 78 and passageway 42 which communicates with the tank port R.

When exciting both pilot valves 12, 14, the valve bodies 18, 20 are moved into switching position as shown in FIG. 4. In this position, the pump pot P is connected via passageway 38, the central bore 16, the annular chamber 72, the passageway 48, the annular chamber 74, the annular chamber 76, the passageway 50, the annular chamber 70 and the passageway 40 with the working port A which communicates with the consumer.

In addition, pressure fluid flows via the branches 46 which are connected to the pump port P and via the control channels 54, 60 into the annular channel 90 of the pilot valve 40 and into the annular channel 88 of the pilot valve 12.

The further connection to the control channels 52, 58 is barred by the pistons 96, 98 of both pilot valves 12, 14. However, both control channels 52, 58 are in communication with passageway 42 and thus with the tank port R via the respective pilot valve and the associated control channels 56, 62 as well as via the associated annular channels 68, 78 and the branch 44. Thus, the spring chambers 120 which, as previously described respectively communicate with the control channel 52 and control channel 58, are pressure-relieved. Since, however, the central bore 16 is subjected to the supply pressure in the area between both valve bodies 28, both valve bodies 18, 20 are axially pushed apart into the switching position as shown in FIG. 4 in which, as already noted, the working port A is in communication with the pump port P.

Figure 5:
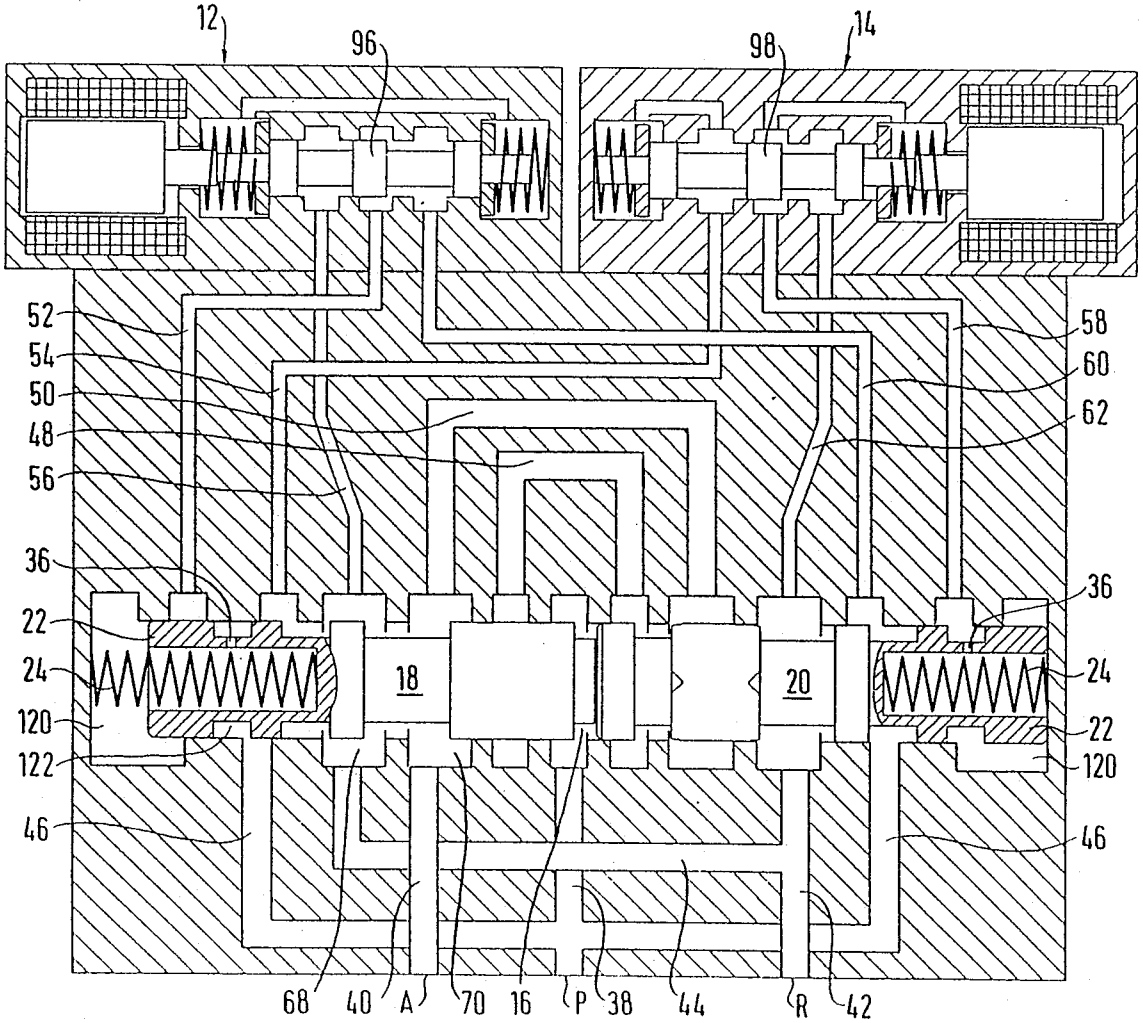
FIGS. 5 and 6 are each a sectional view of the safety valve according to FIG. 2 upon occurrence of a faulty switching.

Turning now to FIG. 5, there is shown a faulty switching in which the pilot valve 14 i.e. the proportional valve is switched while pilot valve 12 remains without current and thus is not switched.

Upon occurrence of such a faulty switching, the left working piston 22 is acted upon by pressure and occupies the position corresponding to the normal position according to FIG. 2. The right working piston 22, however, is pressure-relieved as the proportional valve 14 has switched over and, as already described with reference to FIG. 4, is connected with passageway 42 and thus with the tank port R via the control channel 58, the proportional valve 14, the control channel 62 and the annular channel 78. The right spring chamber 120 is thus pressureless while the left spring chamber 120 is acted upon by the supply pressure as already described. Since further the central bore 16 between both valve bodies 18,20 is also subjected to the supply pressure, the right valve body 20 is displaced to the right by the supply pressure against the force of the right compression spring 24 until abutting the housing as shown in FIG. 5.

As the supply pressure prevails in the central bore 16 as well as in the spring chamber 120, the pressure forces acting upon the valve body 18 compensate each other so that the valve body 18 is shifted towards the right under the action of its compression spring 24 until abutting the right valve body 20 as shown in FIG. 5. In this position, the left spring chamber 120 is connected with the branch 46 and thus with the pump port P via the blind-end bore of the left working piston 22, the transverse bore 36 and annular groove 122 of the working piston 22. The working port A is connected via annular channels 70, 68 and passageways 44, 42 with the tank port R and thus is pressure-relieved.

This position of the safety valve 10 cannot be altered even when subsequently switching over the pilot valve 12 because the left spring chamber 120 still remains under supply pressure. Furthermore, the right spring chamber 120 cannot be acted upon by pressure even when switching over the proportional valve 14 because the valve 14 is connected with the passageway 42 and thus with the tank port R via the control channel 54, the pocket 66, the annular channel 68 and the passageway 44. In order to operate the valve again, the malfunction must be eliminated and the valve must be returned to its normal position through pressure relief at pump port P.

Figure 6:
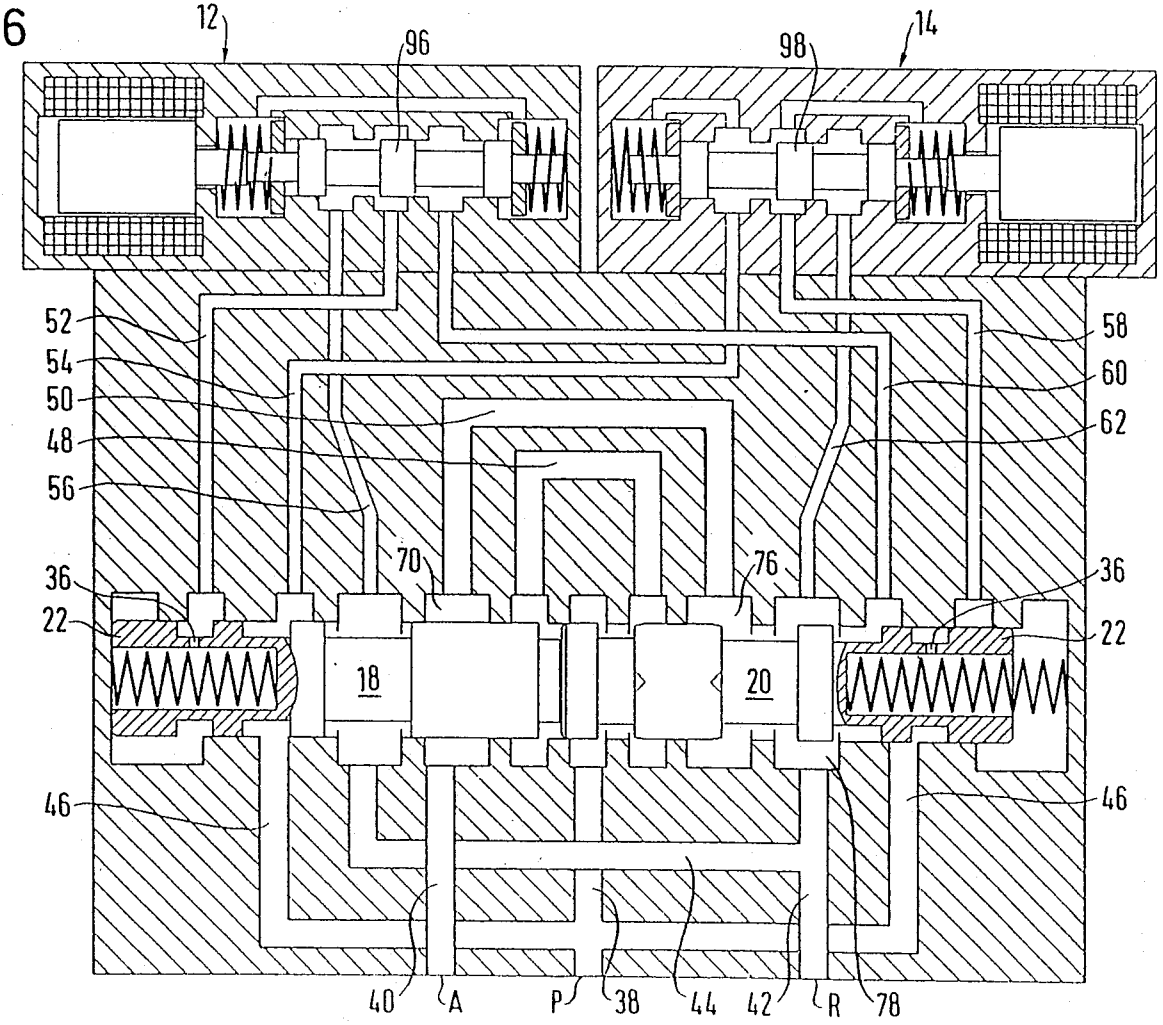

FIG. 6 illustrates a faulty switching in which the pilot valve 12 is switched while the proportional valve 14 malfunctions and is not switched over. Upon occurrence of such a faulty switching, the left spring chamber 120 is pressure-relieved while the right spring chamber 120 is acted upon by the full pump pressure so that both valve bodies 18 and 20 are displaced towards the left until the left working piston 22 abuts the housing while the right valve body 20 abuts the left valve body 18. The working port A is in communication with the passageway 42 and thus with the tank port R via the passageway 40, the annular channel 70, the passageway 50, the annular channel 76 and the annular channel 78.

It will be appreciated that same conditions exist in the faulty switching as shown in FIG. 6 as in FIG. 5 only in reversed order so that a further description of the faulty switching according to FIG. 6 is not necessary.

Figure 3:
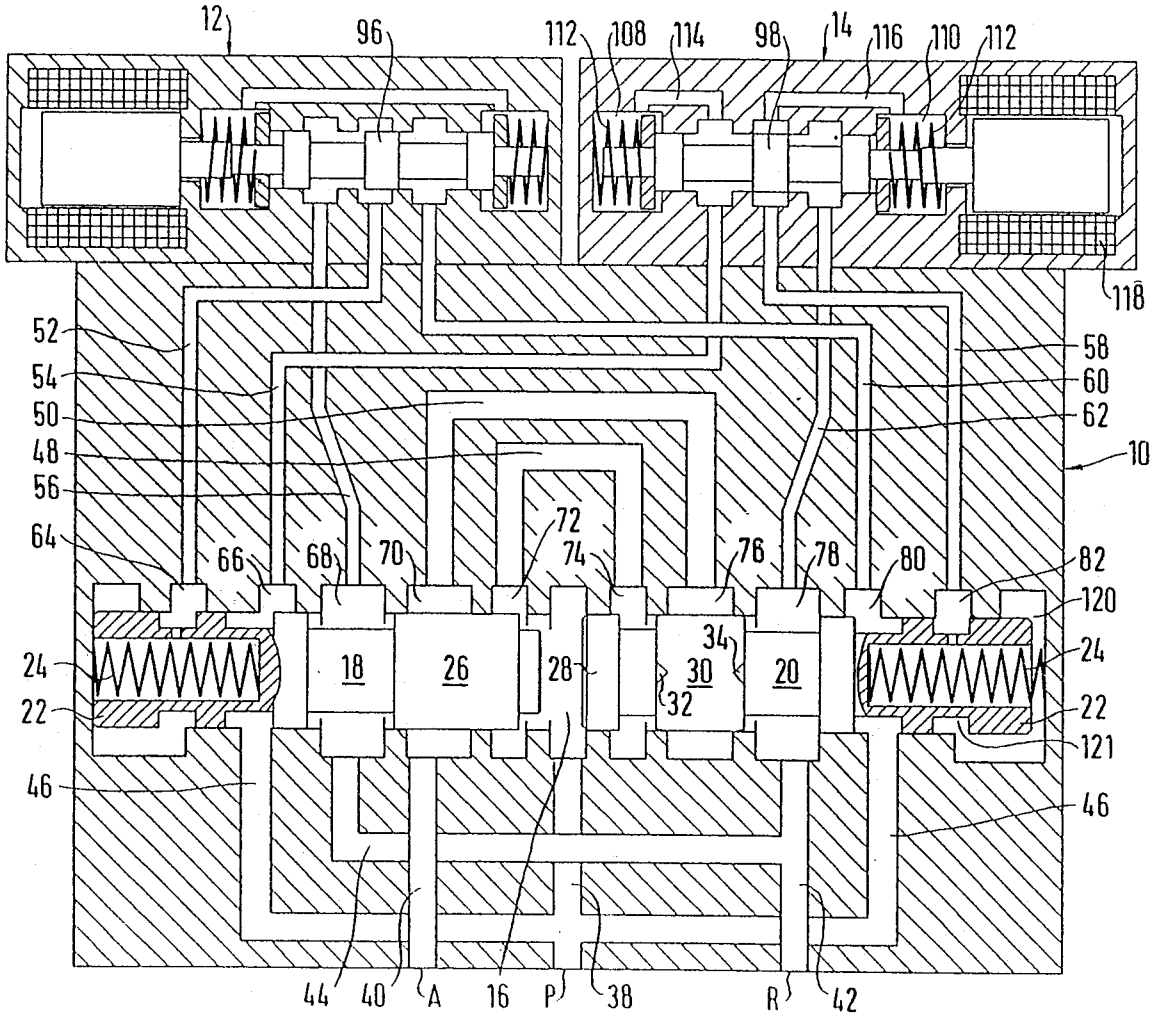
FIG. 3 is a sectional view of the safety valve according to FIG. 2 in regulating position.

In FIG. 3, the regulating position of the safety valve is shown. As already described with reference to FIG. 1, the piston 98 is retained in its central position by the compression springs 112 when the electromagnet of the proportional valve 14 is in currentless state. When activating the proportional magnet 118 with a certain current, the piston 98 is shifted towards the left against the force of the left spring 112 within the spring chamber 108 to thereby throttle the connection between control channel 58 and control channel 54, i.e. the connection between working port A and pump port P, and to thereby open the connection between control channel 58 and control channel 62 i.e. the connection between working port A and tank port R so that the pressure at working port A, i.e. at control channel 58 is reduced. The piston 98 thus occupies a position in which the forces acting at its end faces are balanced.

Thus, in accordance with the equation, the spring force of the left spring 112 plus the pressure force in the left spring chamber 108 equals the force of the proportional magnet 118 plus the pressure force in the right chamber 110.

Since the spring force of the left compression spring 112 and the pressure force in the left spring chamber 108 are essentially constant upon regulating the proportional valve 14, the pressure force in the right spring chamber 110 decreases with increasing force of the proportional magnet 118. The differential pressure between the spring chamber 108 and the spring chamber 110 can thus be adjusted by the proportional magnet. In case the proportional magnet is currentless, the differential pressure between control channel 54 and control channel 58, i.e. between pump port P and working port A equals zero. On the other hand, in case the current is at a maximum, this differential pressure reaches a maximum value.

In FIG. 3, the pilot valve 12 is switched, i.e. it occupies the same position as in FIG. 4. The proportional valve 14, however, is not fully switched over but is activated in such a manner that its piston 98 occupies a regulating position in which a pressure drop prevails within the safety valve 10 between the space 16, which is the part of the central bore between both valve bodies 18, 20, and the right spring chamber 120 because the full pump pressure prevails in space 16 while the spring chamber 120 is connected via the transverse bore 36 as well as via the annular channel 121 of piston 22, the pocket 82, the control channel 58 and the regulating position of piston 98 to the control channel 62 which is in communication with the tank port R via the annular channel 78.

The activating current of the proportional magnet 118 and thus the regulating position of the piston 98 is selected in such a manner that the fine control notches 34, which connect the working port A to the tank port R just close while the fine control notches 32 are not yet open, i.e. the connection between pump port P to working port A is still closed.

By increasing the current at the proportional magnet 118, the piston 98 of the proportional valve 14 moves to the left to thereby further throttle the connection from pump port P via the control channel 54 to the control channel 58 and thus to the right spring chamber 120, and to thereby further open the connection from the control channel 58 and thus from the right spring chamber 120 to the control channel 62 and thus to the tank port R. Thence, the pressure in the right spring chamber 120 decreases, thereby increasing the differential pressure between the space 16 and the right spring chamber 120 so that the valve body 20 is slightly shifted further to the right. The fine control notches 32 clear a respective cross-section from the annular channel 74 to the annular channel 76 so that the pump port P communicates with the working port A via the passageway 38, the central bore 16, the annular channel 72, the passageway 74, the fine control notches 32, the annular channel 76, the passageway 50 and the passageway 40 and thus to the working port A. The fine control notches 34 are closed.

By suitably activating the proportional magnet 118, the cross sectional area of the fine control notches can be modified so as to allow a control of the speed and pressure built up at the consumer which is connected to the working port A.

While the invention has been illustrated and described as embodied in a safety valve, it is not intended to be limited to the details shown since various modifications and structural changes may be made without departing in any way from the spirit of the present invention.

What is claimed is new and desired to be protected by letters patent is set forth in the appended claims:

I claim:

1. A safety valve assembly, comprising:

a valve housing defining a bore and having a fluid inlet port, a tank port and a working port connected to a fluid operated system;

valve means including two valve bodies movable in opposite direction towards each other in said bore of said housing, each of said valve bodies including a working piston and at least one control piston connected to said working piston for regulating the flow of a pressure fluid between said fluid inlet port, said tank port and said working port wherein said working port is connectable to said tank port upon occurrence of a faulty switching; and actuating means for displacing said valve bodies in said bore of said housing and including one pilot valve designed as a proportional pressure differential valve, said control piston of said working piston operatively connected with said proportional pressure differential valve being provided with fine control notches.

2. A safety valve assembly as defined in claim 1 wherein said proportional pressure differential valve includes a piston and has a first port connectable to said fluid inlet port and a second port connectable to said working port, said piston controlling said first port and said second port in such a manner that the connection therebetween and thus between said fluid inlet port and said working port is throttleable.

3. A safety valve assembly as defined in claim 2 wherein said proportional pressure differential valve includes a spring chamber at opposing ends thereof and spring means accommodated in said spring chambers for keeping said piston in a central position.

4. A safety valve assembly as defined in claim 3 wherein said proportional pressure differential valve includes a passageway connecting one of said spring chambers with said first port and another passageway connecting the other one of said spring chambers with said second port.

5. A safety valve assembly as defined in claim 1 wherein said control piston of said working piston operatively connected to said proportional pressure differential valve has opposing end faces and is provided with at least one fine control notch extending from each of its end faces.

6. A safety valve assembly as defined in claim 1 wherein one of said fine control notches controls the connection between said fluid inlet port and said working port and the other one of said fine control notches controls the connection between said working port and said tank port.

7. A safety valve assembly as defined in claim 1 wherein said actuating means includes two pilot valves mounted to said housing.

* * * * *